United States Patent [19]

Beane

[11] Patent Number: 4,631,630

[45] Date of Patent: Dec. 23, 1986

[54] METHOD OF SUPPRESSING THE EFFECTS OF STATIC ELECTRICITY IN A TUMBLE DRIER FOR TEXTILE GOODS

[76] Inventor: Thomas F. Beane, P.O. Box 708, Concord, N.C. 28025

[21] Appl. No.: 815,509

[22] Filed: Jan. 2, 1986

[51] Int. Cl.[4] ..... H05F 3/00

[52] U.S. Cl. ..... 361/212; 361/220; 57/901; 428/922; 34/9; 34/12

[58] Field of Search ..... 361/212, 220; 57/901; 34/9, 12, 60; 427/242; 428/922

[56] References Cited

U.S. PATENT DOCUMENTS 4,098,937 7/1978 Mizuno et al. ..... 427/242 X
4,190,874 2/1980 Pasold ..... 361/212
4,322,232 3/1982 Beane ..... 66/136 X
4,420,529 12/1983 Westhead ..... 57/901 X

*Primary Examiner*—L. T. Hix
*Assistant Examiner*—Douglas S. Lee
*Attorney, Agent, or Firm*—Daniel E. McConnell

[57] ABSTRACT

This invention relates to suppressing or avoiding the effects of static electricity otherwise accumulated on or in textile goods dried in a tumble drier of the type commonly used in home and commercial laundries and in certain textile finishing processes by including with a batch of goods undergoing drying a re-usable textile fabric having particular qualities. The static dissipating textile fabric contemplated by this invention may be re-used indefinitely while continuing to accomplish the suppression of the undesired effects.

12 Claims, No Drawings

METHOD OF SUPPRESSING THE EFFECTS OF STATIC ELECTRICITY IN A TUMBLE DRIER FOR TEXTILE GOODS

FIELD AND BACKGROUND OF INVENTION

This invention relates to suppressing or avoiding the effects of static electricity otherwise accumulated on or in textile goods dried in a tumble drier of the type commonly used in home and commercial laundries and in certain textile finishing processes.

The effects of static electrical charge generation and accumulation on drying of textile goods are well known, and have been most commonly learned from the use of home laundry appliances. Where batches of textile goods such as clothing are processed by being tumbled while heated air is flowed through the goods and the tumbler, the combined actions result in the generation of static electrical charges. The presence of such charges is most notable in the "cling" of goods so processed.

Some substantial effort has been put forth toward suppressing the effects of such static, and some commercial success has been achieved by certain products used to pursue that purpose. Methods have been proposed in which aerosol sprays are injected into a drier on loading of goods. Drying while including especially treated strips of non-woven fabrics has been developed and offered. Chemical agents to be used during a wet wash preceding a drying cycle have been developed and offered.

All such approaches use methods in which an essential ingredient is a consumable. The aerosol sprays are used up, the strips of non-woven fabric become exhausted, and the chemical agents literally wash away. Thus there has been an ongoing need for a method which avoids the undesirable economic necessity of replenishing a consumable material.

BRIEF DESCRIPTION OF INVENTION

With the foregoing in mind, it is an object of this invention to accomplish the suppression of the effects of static electrical charge accumulation in textile goods dried in a tumble drier by including with a batch of goods undergoing drying a re-usable textile fabric having particular qualities which accomplish the desired result. In realizing this object of the present invention, the tasks of handling the textile goods after drying are simplified while the costs of prior comparable procedures are avoided. The static dissipating textile fabric contemplated by this invention may be reused indefinitely while continuing to accomplish the suppression of the undesired effects.

DETAILED-DESCRIPTION OF INVENTION

While the present invention will be described more fully hereinafter with reference to a preferred embodiment of the present invention, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

It has been determined that a textile fabric containing an electrically conductive strand material, when included in a batch of textile goods to be processed in a tumble drier as generally described above, will dissipate static electrical charges otherwise possibly accumulating on and in the textile goods during drying. The present invention takes advantage of this determination by contemplating a method which includes the steps of preparing such a fabric and drying textile goods with such a fabric included in a batch being processed so as to dissipate static charges during drying.

In accordance with the present invention, a static dissipating fabric has particular characteristics as pointed out more fully hereinafter, such that electrostatic charges otherwise possibly accumulating on textile goods with which the fabric comes into contact are discharged or dissipated. In particular, the fabric is formed of strand materials, predominantly and preferably a non-conductive synthetic strand material such as polyester, knitted into courses and wales. An electrical conductive strand material is knitted with the non-conductive strand material, giving the fabric its particular characteristics. The strand materials may be knit with a plain knit construction or may be knit with a pile knit construction. In the latter instance, the conductive strand may be knit with stitches forming the ground or base fabric from which the pile extends, or may be knit with stitches forming loop pile. Where a pile fabric is used, placement of the conductive strand with the pile loops may contribute to maximization of the desired effects, and therefore may be preferable.

The conductive strand used preferably is a synthetic monofilament yarn having electrically conductive characteristics due to the inclusion of conductive materials in the strand as extruded. Such strands are available commercially in the form of monofilament nylon having carbon black extruded as a bicomponent. Other forms of such conductive strands will be known to persons of appropriate skill in the applicable arts.

A fabric useful in practicing the methods of this invention is shown in U.S. Pat. No. 4,322,232, the disclosure of which is hereby incorporated by reference into the present disclosure to any extent necessary for a full understanding of the present invention. As there shown, the conductive strands present in the fabric preferably are arranged, due to the knitting process, in courses or bands in the fabric. By spacing such courses, a greater dissipation effect is achieved through the provision of more clearly defined pathways for the electrostatic charges to follow. The fabric may be a plain knit fabric or a pile fabric. If the fabric is a pile fabric, it is particularly advantageous to put the conductive strand material into the loop pile stitches. Persons skilled in the arts of knitting will be able to determine other knit fabric constructions through which the advantages of the present invention may be realized.

It has been determined through experimentation with fabrics of the types referred to that effective dissipation of static charges is related to the percentage of conductive strand materials included in the static dissipating fabric. More particularly, it has been found that effective static suppression does not occur where the content of conductive strand material is above about ten percent of the weight of the fabric. Optimal suppression has been found to occur with conductive strand material content which is in a range of from about two up to about four percent by weight of the fabric.

In the foregoing specification there has been set forth a preferred embodiment of the invention and, although specific terms are used, the description thus given uses terminology in a generic and descriptive sense only and not for purposes of limitation.

What is claimed is:

1. A method of suppressing the effects of static electricity in the operation of a tumble drier for textile goods and comprising the steps of preparing a textile fabric containing an electrically conductive strand material, including the prepared textile fabric in a batch of textile goods to be processed in the tumble drier, and drying the goods while dissipating through the prepared textile fabric static electrical charges otherwise possibly accumulating on and in the textile goods during drying.

2. A method according to claim 1 wherein the step of preparing a textile fabric comprises knitting non-conductive strand material together with a minor portion of conductive strand material.

3. A method according to claim 2 wherein the step of knitting strand materials includes selecting a minor portion of conductive strand material to make up no more than ten percent by weight of the knitted together strand materials.

4. A method according to claim 2 wherein the step of knitting strand materials includes selecting a non-conductive synthetic strand material to make up the major portion of the fabric and selecting a conductive synthetic strand material to make up no more than about four percent by weight of the knitted together strand materials.

5. A method according to claim 1 wherein the step of preparing a textile fabric comprises knitting strand materials into a plain knit construction.

6. A method according to claim 1 wherein the step of preparing a textile fabric comprises knitting strand materials into a pile knit construction.

7. A method according to claim 6 wherein the step of knitting includes forming strand materials into stitches defining a ground and stitches defining loop pile extending from the ground, and further wherein the conductive strand material is knit with stitches defining loop pile.

8. A method according to claim 1 further comprising the step of selecting as said conductive strand material a synthetic monofilament yarn having electrically conductive characteristics due to the inclusion of conductive materials in the strand as extruded.

9. A method of suppressing the effects of static electricity in the operation of a tumble drier for textile goods and comprising the steps of selecting a non-conductive synthetic strand material to make up the major portion of a static dissipating fabric, selecting a synthetic strand material having electrically conductive characteristics due to the inclusion of conductive materials in the strand as extruded to make up no more than six percent by weight of the static dissipating fabric, knitting the strand materials together to form the static dissipating fabric, including the knitted fabric in a batch of textile goods to be processed in the tumble drier, and drying the goods while dissipating through the knitted fabric static electrical charges otherwise possibly accumulating on and in the textile goods during drying.

10. A method according to claim 9 wherein the step of knitting strand materials comprises forming a plain knit construction.

11. A method according to claim 9 wherein the step of knitting strand materials comprises forming a pile knit construction.

12. A method according to claim 11 wherein the step of knitting includes forming strand materials into stitches defining a ground and stitches defining loop pile extending from the ground, and further wherein the conductive strand material is knit with stitches defining loop pile.

* * * * *